US005118089A

United States Patent [19]

Yamada et al.

[11] Patent Number: 5,118,089

[45] Date of Patent: Jun. 2, 1992

[54] AUTOMATIC DOCUMENT FEEDING APPARATUS

[75] Inventors: Yasushi Yamada; Osamu Murata, both of Hachioji, Japan

[73] Assignee: Konica Corporation, Tokyo, Japan

[21] Appl. No.: 575,541

[22] Filed: Aug. 30, 1990

[30] Foreign Application Priority Data

| | | | |
|---|---|---|---|
| Sep. 5, 1989 | [JP] | Japan | 1-230224 |
| Sep. 14, 1989 | [JP] | Japan | 1-238853 |
| Sep. 14, 1989 | [JP] | Japan | 1-238861 |

[51] Int. Cl.[5] ..... B65H 7/02

[52] U.S. Cl. ..... 271/3; 271/4; 271/265; 271/266

[58] Field of Search ..... 271/3, 3.1, 4, 110, 271/265, 266

[56] References Cited

U.S. PATENT DOCUMENTS

| | | | |
|---|---|---|---|
| 3,556,512 | 1/1971 | Fackler | 271/4 |
| 3,575,108 | 4/1971 | Scranton | 271/4 |
| 3,936,041 | 2/1976 | Shiina et al. | 271/110 |
| 4,621,799 | 11/1986 | Bastow et al. | 271/265 |

FOREIGN PATENT DOCUMENTS

| | | | |
|---|---|---|---|
| 236136 | 9/1989 | Japan | 271/3 |
| 236137 | 9/1989 | Japan | 271/3 |
| 23146 | 1/1990 | Japan | 271/3 |

*Primary Examiner*—Joseph E. Valenza
*Assistant Examiner*—Steven M. Reiss
*Attorney, Agent, or Firm*—Jordan B. Bierman

[57] ABSTRACT

An automatic document feeding apparatus wherein a plurality of sheet-like documents are fed sheet by sheet to an image exposure portion, and discharge the documents by discharge device after exposed by an optical device. Before completion of the exposure operation of a preceding sheet-like document, a succeeding document is stopped temporarily and kept in the stand-by state at least in two stop positions corresponding to document sizes respectively on the upstream side of the image exposure portion, according to a document size detection signal from document size detection device. That a distance from the leading edge of the succeeding document in the temporary stop state to the leading edge of a preceding document in the image exposure portion is set greater than a distance from the trailing edge of the preceding document in the image exposure portion to a discharge position of the discharge device.

2 Claims, 10 Drawing Sheets

FIG. 7

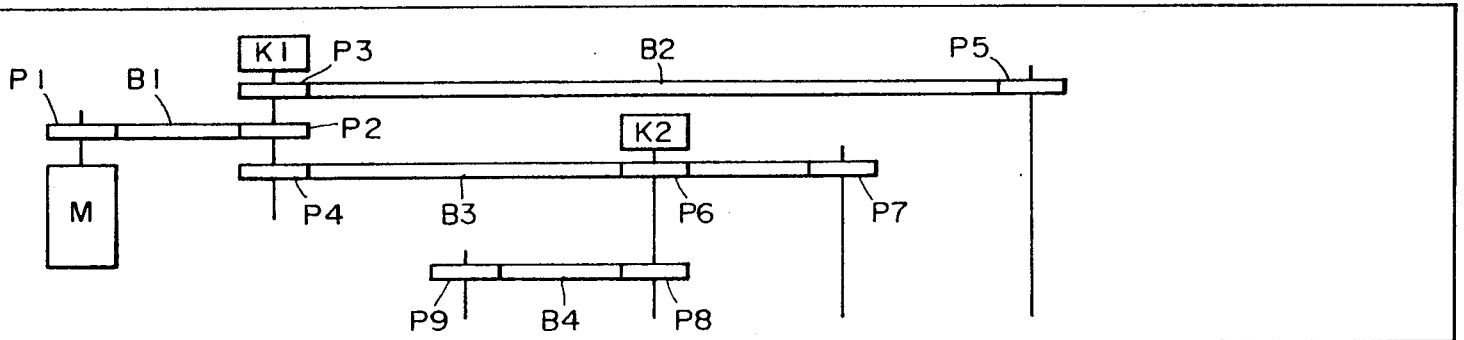

| PAPER FEED ROLLER DRIVING SYSTEM | PERIPHERAL SPEED OF PICK-UP ROLLER (2) | PERIPHERAL SPEED OF FEED ROLLER SHAFT (22) | PERIPHERAL SPEED OF INTERMEDIATE ROLLER SHAFT (23) | PERIPHERAL SPEED OF BELT DRIVING ROLLER (9) | ELECTRO-MAGNETIC CLUTCH K1 | ELECTRO-MAGNETIC CLUTCH K2 |
|---|---|---|---|---|---|---|
| PAPER FEED ROLLER SHAFT PARTS | | | | | | |
| AT DOCUMENT FEED (FROM START TO STOP) | V1' | V1' | V1 | V1 | ON | ON |
| AT SCANNING EXPOSURE (DOCUMENT STOP) | V2' | V2' | V2 | 0 | OFF | ON |
| PRECEDING DOCUMENT DISCHARGE SUCCEEDING DOCUMENT FEED | V1' | V1' | V1 | V1 | ON | ON |

AUTOMATIC DOCUMENT FEEDING APPARATUS

BACKGROUND OF THE INVENTION

1. Field of the Invention

The present invention relates to improvement of an automatic document feeding apparatus mounted on a recording apparatus of an electrophotographic reproducing machine and others.

2. Description of the Prior Art

The automatic document feeding apparatus is generally mounted for use on a document glass plate (platen glass). In a reproducing machine using a movable optical system on which this automatic document feeding apparatus is mounted, documents in sheets (hereinafter referred to simply as documents) of standard sizes (for example, JIS Standard A series, B series, or USA Standard sizes) are stacked on a document stacker (stacking section), and each sheet of the documents is fed out one by one from the stack by feed rollers and others of the automatic document feeding apparatus and is carried by a carrier belt onto the document glass plate where exposures of a given number of copies are conducted with an exposure lamp equipped in the body of the reproducing machine. Then, each of the documents is delivered onto a document delivery tray.

Conventionally, in the operation of replacing documents on the document glass plate the next document is fed out from the stack after a delivery sensor has detected the delivery of the preceding document from the document glass plate. Then, this next document is carried to the document glass plate and placed at a given position thereon. Thus, it takes a long time to complete replacing the document. Hence, the copy processing time becomes elongated.

Copy productivity will drop because of the document replacement operation on the document glass plate in such an automatic document feeding apparatus unless the feeding and ejecting of the documents are executed in a short period. In other words, it is desirable that the copy processing speed CPM (number of copies processed per minute) of the image forming process on the reproducing machine main side is substantially equal to the document processing speed OPM (number of documents conveyed per minute) of the automatic document feeding apparatus.

However, in a case where documents are automatically fed and delivered onto the document glass plate for replacement using an automatic document feeding apparatus, the productivity of copying documents becomes 100% and no wasteful time is consumed, if the replacement of the documents is performed during the period in which the scanning optical system is returned to its home position.

In a reproducing machine capable of high speed copy processing, the document replacement time is reduced by increasing the document conveying speed from a document double-feed prevention position in the stack portion to the document stop position on the document glass plate surface and the ejecting speed of ejecting the document from the document stop position to the outside of the machine. Further, another method of reducing the document replacement time has been employed which starts the feed of the next document on the document placement table almost at the same time of the start of the ejection operation of the document which has been subjected to image exposure.

Therefore, the document conveying speed from the document double-feed prevention position of the stack portion to the document stop position on the document glass plate surface must be raised.

When the document conveying speed is increased, however, there occur various problems such as the use of a greater motor, the increase in power consumption, the increase in damages of the documents, the drop of document separability, and so forth.

In order to further shorten the document replacement time and to improve the document processing speed (OPM), an automatic document feeding apparatus for conveying a sheet-like document to an image exposure portion, stopping the document at the image exposure portion, moving an optical system to make scanning exposure and delivering the document after exposure to a document ejection table is proposed. Such automatic document feeding apparatus comprises a first driving system consisting of feed rollers for feeding the document to an intermediate conveyor roller and to the image exposure portion and of separation means and a second driving system for conveying, stopping and ejecting the document onto, at and from the image exposure portion by a conveyor belt or the like, in which the first driving system is driven within at least part of the exposure time during which the document is stopped at the predetermined position of the image exposure portion and is subjected to scanning exposure, so that at least part of the feeding operation of the next document is made.

In such an automatic document feeding apparatus, the second driving system has a certain time lag from the start of driving till it operates at a predetermined speed. Accordingly, if the trailing edge of the document completely leaves the intermediate conveyor roller for feeding the document into the image exposure portion before the document reaches the image exposure portion, is sufficiently pressed by the conveyor member and conveyed reliably at a predetermined speed; the conveyance of the document becomes unstable, and there occur conveyance failures such as jamming of the document, and failure of arrival of the document at the predetermined stopper position. These problems are serious particularly in the case of documents having small sizes (e.g. B5; transverse position, 182 mm long).

SUMMARY OF THE INVENTION

An object of the present invention is to solve the problems with the automatic document feeding apparatus described above and to increase the number of copies processed.

The object described above can be attained by an automatic document feeding apparatus which conveys sequentially a plurality of sheet-like documents to an image exposure portion, stops the documents at the image exposure portion, moves an optical system to make scanning exposure and discharges the documents after exposure by discharge means, and is characterized in that the feed of the succeeding sheet-like document is started before completion of the exposure operation of a preceding sheet-like document, a succeeding document is stopped temporarily at a predetermined position on the upstream side of the image exposure portion and is brought into the standby state, and in that a distance from the leading edge of the succeeding document in the temporary stop state to the leading edge of a preceding document in the image exposure portion is set greater than the distance from the trailing edge of the preceding document in the image exposure portion to a discharge position of the discharge means.

The above object can be attained further by the automatic document feeding apparatus wherein the succeeding document is stopped temporarily and kept in the stand-by state at least in two stop positions corresponding to document sizes respectively, according to a document size detection signal from document size detection means, and the distance from the temporary stop position to the leading edge of the preceding document under the stop state in the image exposure portion is set greater than the distance from the trailing edge of the preceding document to the discharge means described above.

Further, the above object can be attained by an automatic document feeding apparatus which separates one by one documents stacked on a document stacker, feeds it to an image exposure portion, stops a document at the image exposure portion, moves an optical system to make scanning exposure and delivers the document onto a document ejection table after exposure, and is characterized in that the feed of a succeeding sheet-like document is in advance started before completion of the exposure operation of a preceding sheet-like document, and stops it temporarily in a predetermined position on the downstream side of the image exposure portion, and in that the following formula is satisfied:

$$V_1 > V_2 \geqq x/t$$

where $v_1$: document conveying speed in image exposure portion, $v_2$: speed of succeeding document till it reaches the temporary stop position, x: conveying distance from the leading edge of document on document stacker in feeding direction to temporary stop position, t: image formation time for scanning exposing document on image exposure portion.

Furthermore, the above object can be attained by an automatic document feeding apparatus that separates one by one documents stacked on a document stacker by separation means, conveys each document to an image exposure portion at a main conveying speed, stops the document in the image exposure portion, moves an optical system so as to make scanning exposure, delivers the document outside after exposure by ejecting means, starts the feed of a succeeding document before completion of the exposure of a preceding document and stops the succeeding document temporarily at a predetermined position on the upstream side of the image exposure portion, and is characterized in that at least a pair of intermediate conveyor rollers are provided on the downstream side of the separation means in the conveying direction, the temporary stop positions are set between the intermediate conveyor rollers and the image exposure portion so that when the documents having various sizes are conveyed from this temporary stop position, the documents may become conveyed at the main conveying speed before the trailing edge of the document leaves completely the intermediate conveyor roller.

The above and other objects and novel features of the present invention will become more apparent from the following description when taken in conjunction with the accompanying drawings.

BRIEF DESCRIPTION OF THE DRAWINGS

FIG. 7 is a diagram showing the rotating speed of each paper feed roller by the driving system;

DESCRIPTION OF THE PREFERRED EMBODIMENTS

Figure 1:
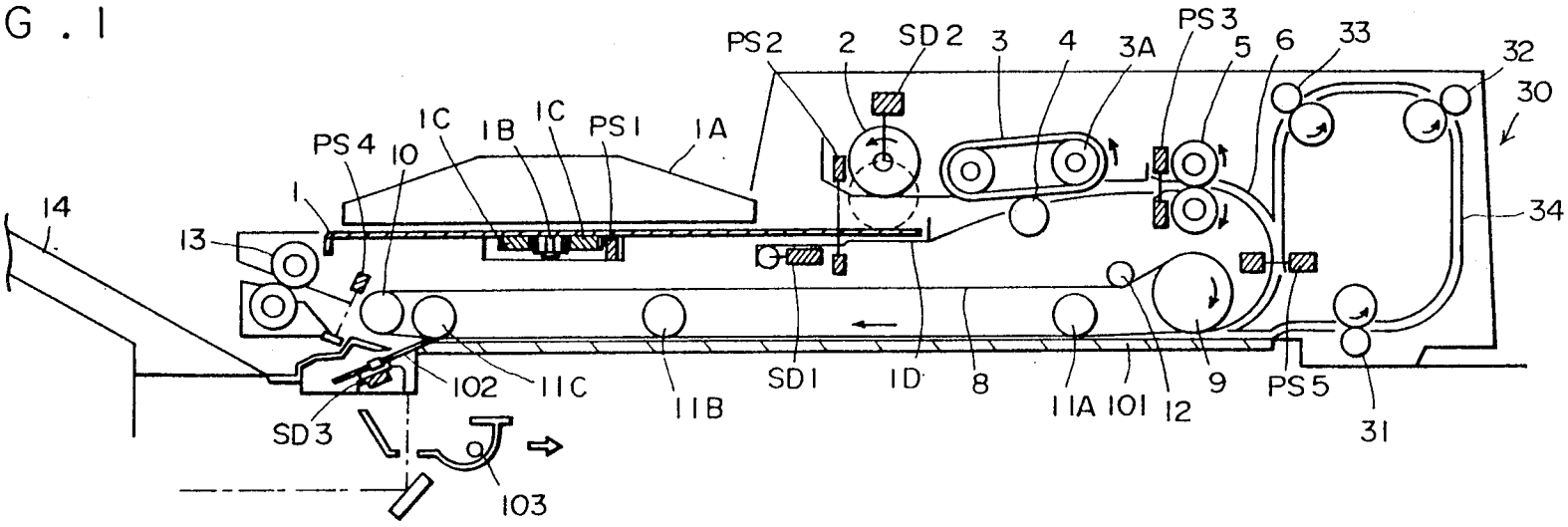
FIG. 1 is a structural view showing a document conveying path of an automatic document feeding apparatus in accordance with the present invention.

With reference to the drawings, an embodiment according to the present invention will subsequently be described in detail.

The apparatus shown in the drawings is an automatic document feeding apparatus (RADF) with automatic document reversing function.

First, with reference to FIGS. 1, 3, 5, and 6(A), the structure and operation of the automatic document feeding apparatus will be described.

On the left side of the upper face of the automatic document feeding apparatus, a document stacker 1 is disposed to stack documents. Provided beneath the front end of said stacker 1 are a document setting solenoid SD1 and a document edge stopper 1D swingable by said solenoid SD1. The upper end of said edge stopper 1D is projected in the vicinity of the end portion of the document stacker 1, and a stack of documents is placed on the stacker 1 in such a manner that the edge of the stack abuts against said document stopper 1D so as to be set in order.

When the stack of documents is placed on the stacker 1, the presence of the documents thereon is detected by a document setting detection sensor PS2 (or sensor for detecting absence of document), and "ADF mode" is indicated on a control panel 110 on a reproducing machine 100.

On said document stacker 1, two breadth regulating boards 1A and 1A are provided to regulate the documents in the lateral direction. Under the document stacker 1, each of the breadth regulating boards 1A is respectively linked with each of racks 1C and 1C which are slidable in the lateral direction relatively, with a pinion 1B sandwitched therebetween. The racks 1C and 1C are connected respectively to the breadth regulating boards 1A and 1A, and the amount of their movement is detected by a document size detecting sensor PS1 so as to read the width of the document. Since the width and length of document of a standard size are naturally fixed (for example, the A4 size is 257 mm wide and 364 mm long), the length of the document is uniquely determined when the width thereof is detected. Therefore, a CPU can automatically find the length of the document D of a standard size in accordance with the measured value of the width. Hence, by sliding the breadth regulating boards 1A and 1A to come into contact with the stacker of documents placed on the document stacker 1, the width of the document of any standard size is detected, and the length is calculated simultaneously by the CPU in accordance with the standardized size, and stored in the memory in order to conduct the control set forth below.

A pick-up roller 2 arranged above and in the vicinity of the end portion of said document stacker 1 is vertically movable by the operation of a feeding solenoid SD2 and the force by a spring, and is also rotatable by the driving force of a driving motor M. The automatic document feeding apparatus is started by operating a copying button 111 provided on said control panel 110. Then, said document feeding solenoid SD2 is actuated to lower the pick-up roller 2 to press the uppermost surface of the stack of documents. The pick-up roller is started to rotate simultaneously by the driving force of the driving motor M for the document feeding.

On the side of downstream of document feeding of the pick-up roller 2, there is provided a means for separating and feeding documents which comprises a feed belt 3 moving around a feed roller 3A, and a double-feed preventive roller 4 located underneath the feed belt 3. Said separating and feeding means separates and feeds only one document of the top of the documents fed out by the pick-up roller 2 which is rotated by the driving force transmitted from the driving motor M through an electromagnetic clutch K2.

On the downstream side of document feeding of said separating and feeding means, there are arranged a document pass detecting sensor PS3, a pair of intermediate conveyor rollers 5, and curved guide plates 6.

The passing of the leading edge of a sheet of document fed out by the separating and feeding means is detected by the document pass detecting sensor PS3, and the sheet of document is subsequently fed by the pair of intermediate conveyor rollers 5 arranged in the vicinity thereof through the guide plates 6. When the leading edge of the sheet of document passes a document synchronization sensor PS5 disposed in the middle of this passage, a detection signal is generated in order to control the document feeding. Said document synchronization sensor PS5 controls through clock timers the operations of a document stopper 102 described later, the driving motor M, a feed clutch K2, a carry clutch K1, and others.

Subsequently, the sheet of document is fed under a pressure between a carrying belt 8 and a document glass plate for document image exposure 101 (hereinafter referred to as a document glass plate) mounted on the upper face of the body of reproducing machine 100, and is stopped by the operation of a document stopper solenoid (latch type) SD3 at a position where the leading edge of the document abuts against the document stopper 102 which is projected from the left end of the upper face of the document glass plate 101.

The carrying belt 8 mentioned above is trained around a carrying belt driving roller 9, a driven roller 10, three document holding rollers 11, and a tension roller 12.

The document is exposed by an exposure lamp 103 in the body of reproducing machine at the stop position on the document glass plate 101. Then, the document image is formed on a recording member by scanning of an optical system comprising lenses, mirrors, and others.

Then, the same exposure process is repeated up to a given number of copies. When a series of copying operations for the document is completed, the projected portion of said document stopper 102 is withdrawn from the upper face of the document glass plate 101 to release the leading edge of the document. The document is delivered by the carrying belt 8 which are again started to rotate, and by a pair of ejecting rollers 13, and after the passing of the trailing end of the document is detected by a document delivery detecting sensor PS4, the document is placed on a delivery tray 14 (stacker for delivered documents).

Furthermore, in this automatic document feeding apparatus, there is provided a document reversing section 30 where a document is reversed through a document reverse passage. Said document reversing section 30 comprises carrying rollers 31, 32, and 33, a guide plate 34, and the document synchronization sensor PS5 for detecting the pass of a reversed document.

Figure 2:
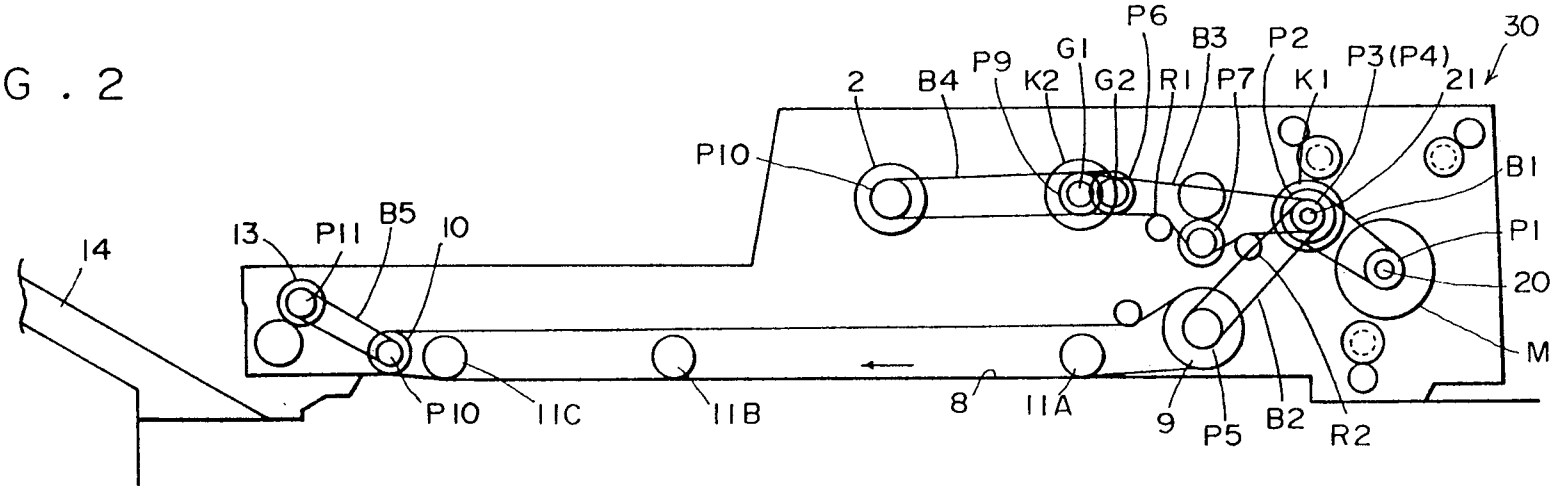
FIG. 2 is a structural view showing a driving system (power transmission system) of the automatic document feeding apparatus.
Figure 3:
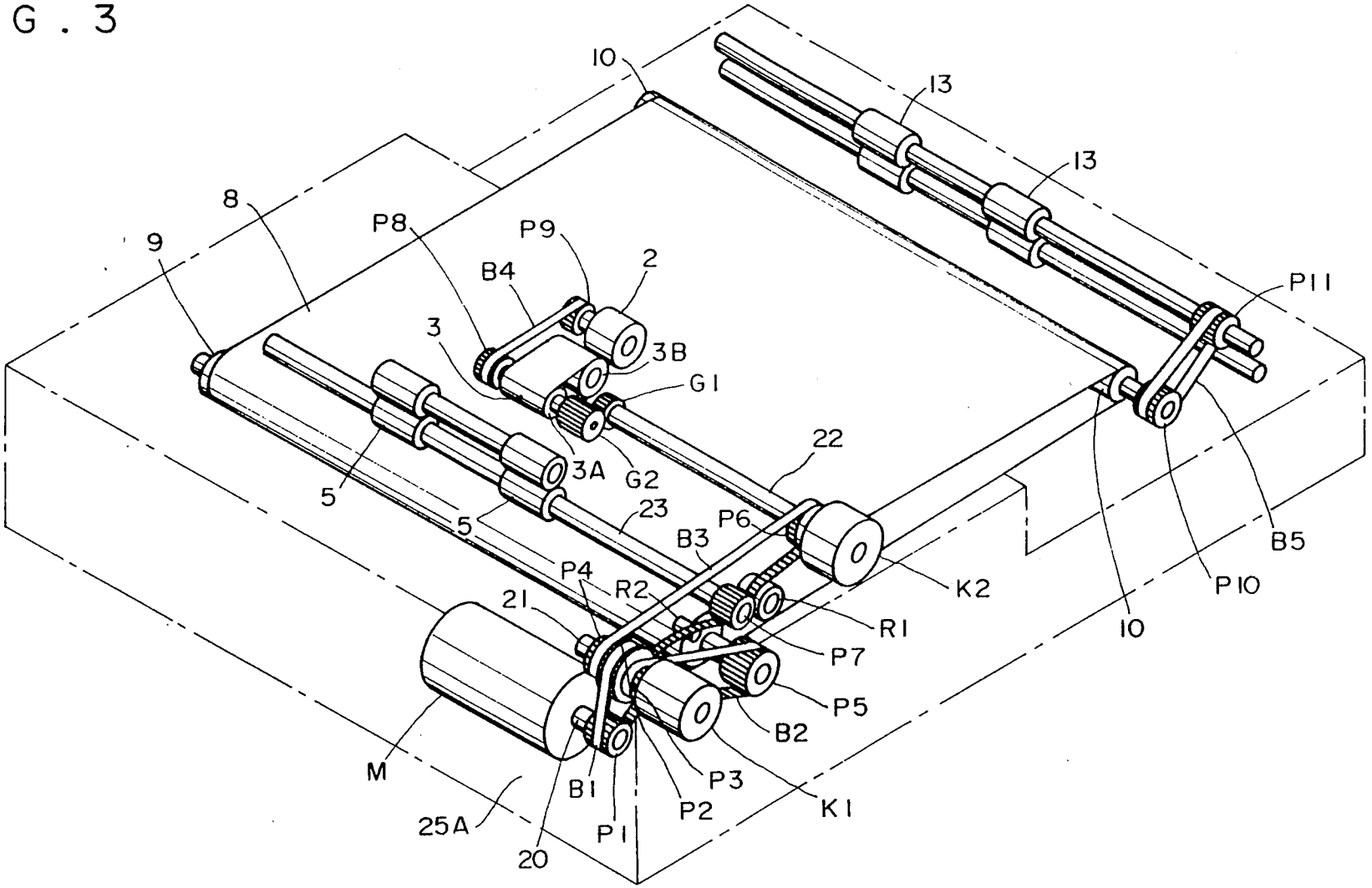
FIG. 3 is a perspective view showing a document conveying system and the driving system inside the apparatus described above.
Figure 4:
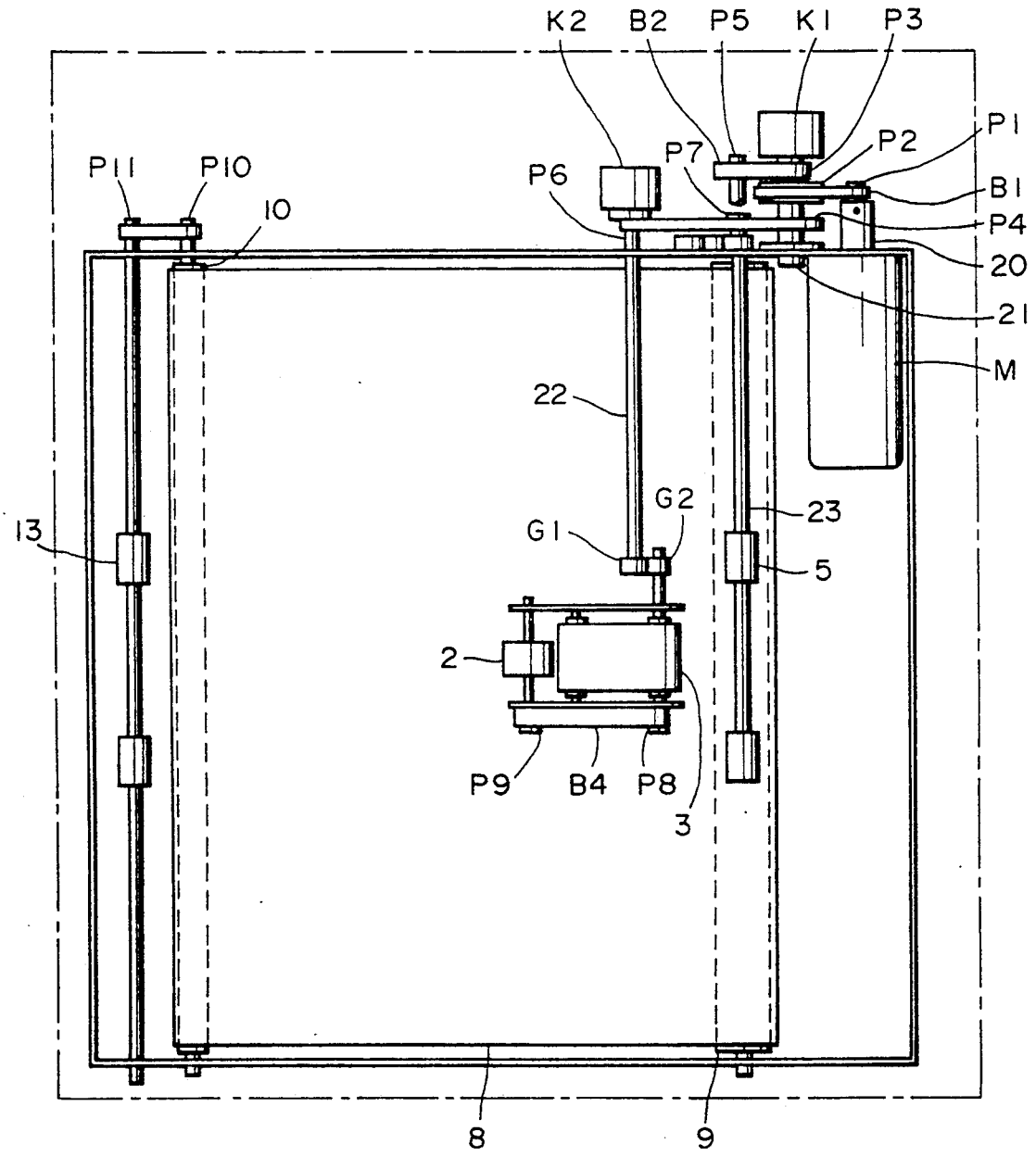
FIG. 4 is a plan view of the principal portions of the automatic document feeding apparatus.
Figure 5:
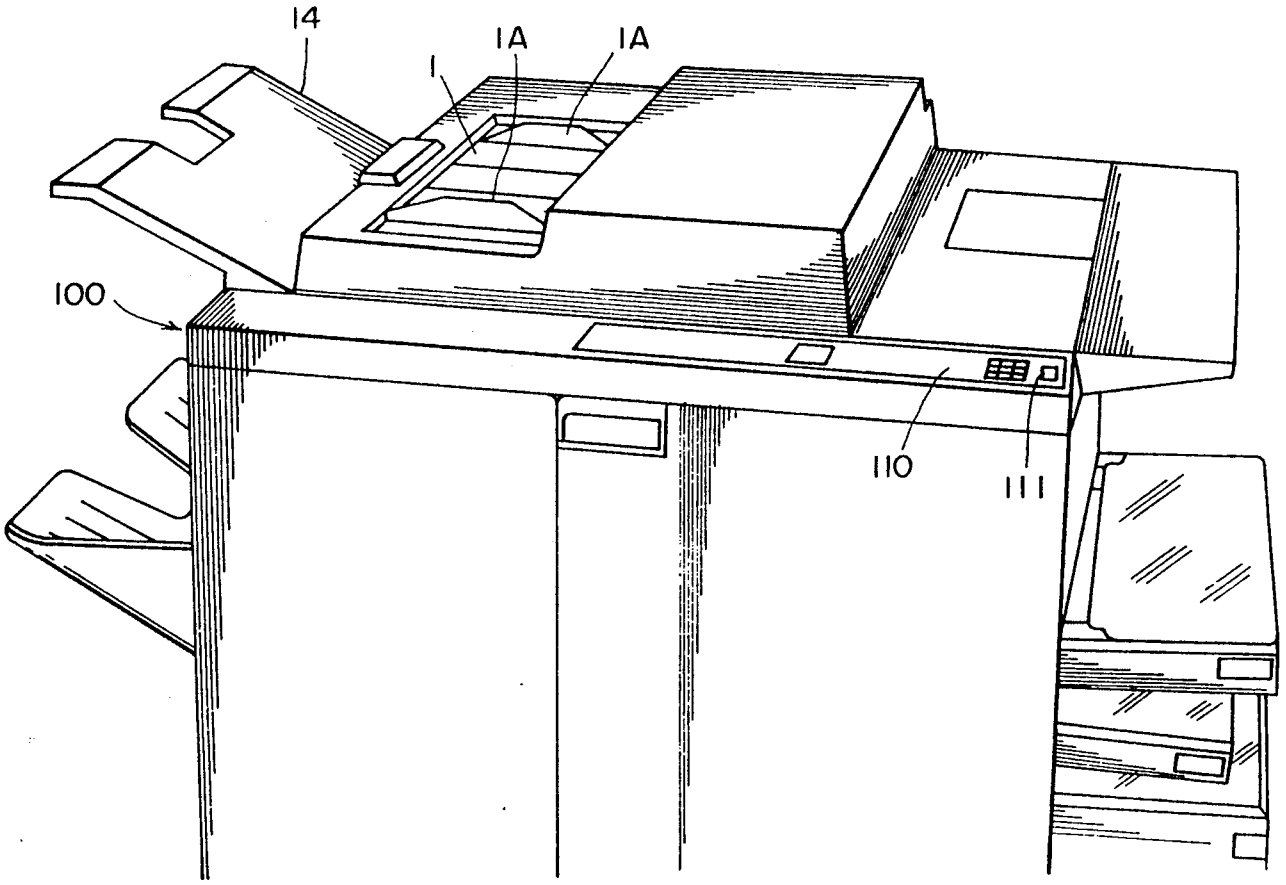
FIG. 5 is a perspective appearance view of the upper part of a reproducing machine on which the automatic document feeding apparatus is mounted.

Subsequently, with reference to FIGS. 2, 3, and 4, a driving system for the rollers and belts mentioned above will be described.

The driving motor M is a servomotor comprising a DC motor and a speed controller (such as an encoder and tachogenerator) as an integrated body. A timing belt B1 is trained around a timing belt pulley P1 integrated with a driving shaft 20 of said servomotor M and a timing belt pulley P2 fixed to an intermediate shaft 21 to be rotated by the motor M.

On the intermediate shaft 21 mentioned above, timing belt pulleys P3 and P4, and the magnetic clutch K1 are mounted in addition to the timing belt pulley P2 mentioned above. Around said timing belt pulley P3 and a timing belt pulley P5 fixed to the shaft-end of said carrying belt driving roller 9, a timing belt B2 is wound rotatably.

By the rotation of said carrying belt driving roller 9, the driven roller 10 is rotated through the carrying belt 8, and the ejecting roller 13 is rotated by the rotation of a timing belt pulley P10 fixed to the shaft-end of the driven roller 10 which is engaged with a timing belt pulley P11 through a timing belt B5.

A timing belt B3 turning wound around the timing belt pulley P4 mounted on said intermediate shaft 21 is engaged with a timing belt pulley P6 mounted at one end of a feed roller shaft 22 which rotates the feed roller 3A through gears G1 and G2, and with a timing belt pulley P7 mounted at the end of a intermediate roller shaft 23 which is integral with the intermediate carrier roller 5. R1 and R2 are tension rollers which are in pressure contact with the outer circumference of the timing belt B3 mentioned above to tension the belt.

By the rotational movement of the timing belt B3, the feed roller 3A is rotated by the feed roller shaft 22 incorporated with the timing pulley P6 through the gears G1 and G2. Thus, the feed belt 3 trained around the feed roller 3A and a free roller 3B is driven so as to rotate also the pick-up roller 2 by timing belt pulleys P8 and P9 and a timing belt B4. In the meantime, at the other end of the feed roller shaft 22, the magnetic clutch K2 is mounted to control the feed belt 3 and the pick-up roller 2 mentioned above in accordance with inputted signals for feeding documents.

When both sides of a document are to be copied, the document whose first face has been exposed for copying by said process is carried on the document glass plate 101 to the right by the carrying belt 8 because the carrying belt driving roller 9 is started to rotate counterclockwise in synchronization with the completion of the exposure operation. The right hand end portion of the document thus carried is brought to said document reversing section 30. Hence, the document D is nipped and fed by carrying rollers 31, 32, and 33 sequentially along the guide plate 34 in the document reversing section 30. Then, the leading edge of the document D is carried onto the document glass plate 101. Before this feeding, the leading edge of the document causes the sensor PS5 for detecting the passing of the reversed document to give a signal for switching said carrying belt driving roller 9 to rotate clockwise again.

The above explanation is as to the schematic structure of the driving system to which power is transmitted from the driving motor M. Next, the document conveying operation by this driving system will be explained.

Figure 6A:
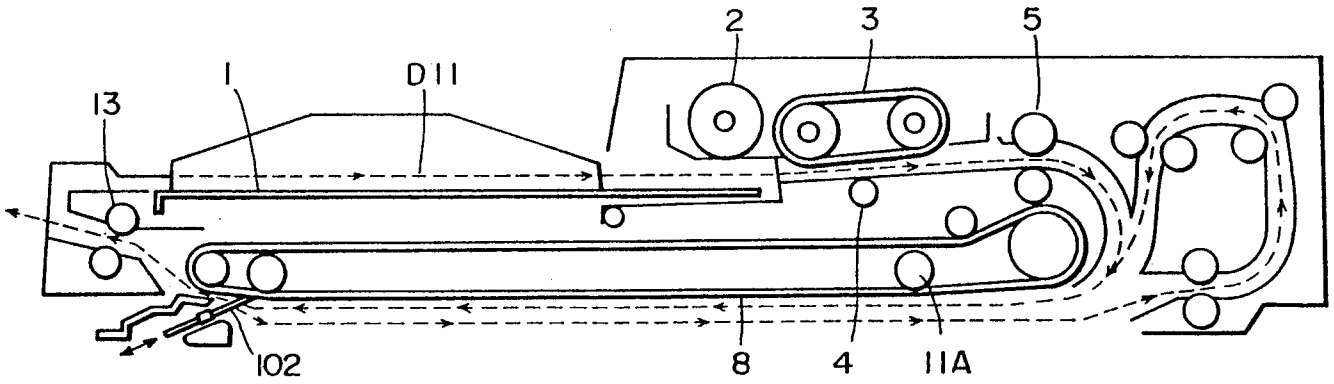
FIGS. 6(A), 6(B) and 6(C) are schematic views each showing the document conveying process.
Figure 6B:
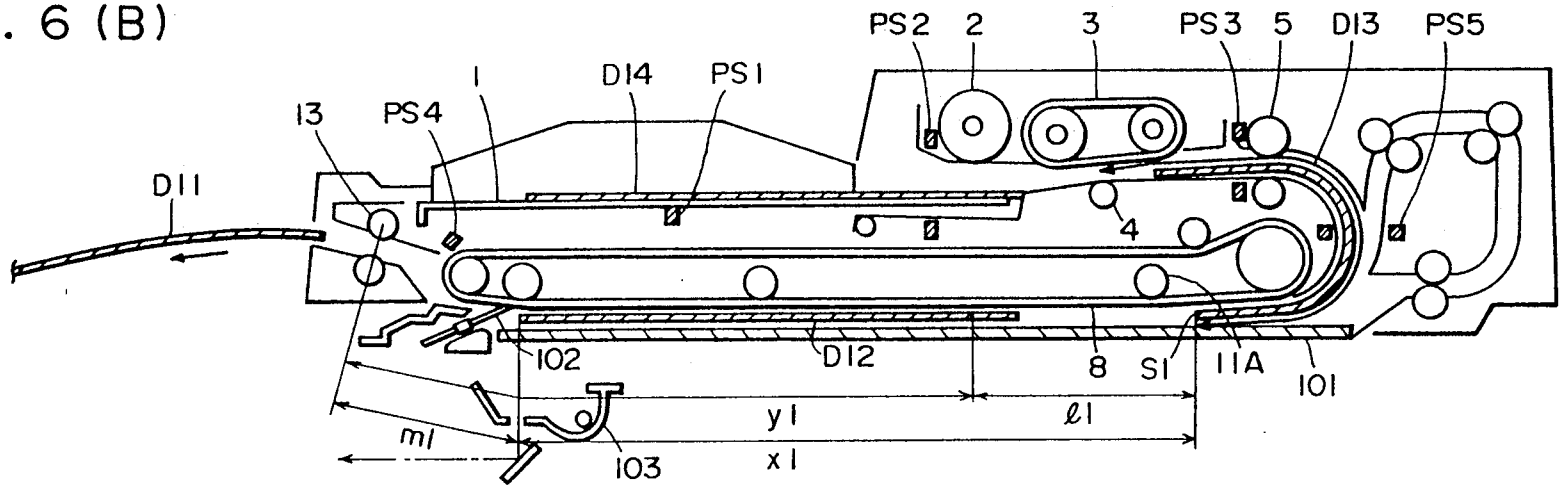

FIG. 6(B) is a schematic view of the feed and conveying process of small-size documents D11, D12, D13, and D14 (e.g. B5, A4, etc.). Here, D11 represents an ejected preceding document which is ejected outside the machine from the ejecting roller 13 of an ejecting means. D12 is a preceding document which is placed on the document glass plate 101 and whose preceding position is limited by the document stopper 102. D13 is a document whose leading edge enters a wedge-like space defined by the document glass plate 101 and the carrying belt 8 near the right end of the document glass plate 101 and is stopped temporarily and kept under the stand-by state. D14 is a document which is placed on the document stacker 1 and is not yet fed.

The leading edge S1 of the succeeding document D13 in the conveying direction is under the temporarily stop and stand-by state at a distance of x1 from the projecting end position of the document stopper 102. An interval between this leading edge S1 and the trailing edge of the preceding document D12 keeps a distance l1. This distance l1 is set to be greater than a distance ml from the projecting end portion of the document stopper 102 to the nip position of the ejecting roller 13 of the ejecting means ($l1 > ml$). Accordingly, the distance x1 is set to be greater than a distance yl from the trailing edge of the preceding document D12 to the ejecting roller 13 ($x1 > y1$).

When the temporary stop position of the leading edge of the succeeding document D13 is thus set, the preceding document D12 and the succeeding document D13 are simultaneously conveyed by the carrying belt 8 while keeping the gap l1 and when the leading edge of the succeeding document D13 abuts against the document stopper 102 and stops, the trailing edge of the preceding document D12 has been ejected from the ejecting roller 13. Therefore, ejection failures due to the catch of the trailing edge does not occur.

The succeeding document D13 that is under the temporary stop and stand-by state is nipped between the feed belt 3 and the intermediate conveyor roller 5, is conveyed by the distance x1 along the conveyor path at a predetermined low speed $v_2$ (e.g. $v_2 = 500$ mm/sec) and reaches and stops at a temporary standup position S1. A time t1 necessary for the preparatory feed of the succeeding document D13 at this speed $v_2$ is set to be shorter than an image formation time t01 ($t01 > t1$) during which scanning exposure is made by the scanning-exposure unit 103 for the preceding document D12 stopped on the document glass plate 101 of which the leading edge abuts against the document stopper 102.

When the preparatory feed speed of the succeeding document D13 and the time necessary for the temporary stop of its tip portion are set in the manner described above, it is possible to feed preparatively the succeeding document D13 to the temporary stop position and to let it stand by there within the scanning exposure (optical scanning going path) time (t01), further to convey simultaneously both the preceding and succeeding documents D12 and D13 with a predetermined gap between them, to eliminate the waiting time between the conveyances of the both documents and thus to improve the conveyance efficiency.

When the leading edge of the succeeding document abuts against the document stopper 102 and stops, the trailing edge of the preceding document is ejected from the ejecting roller 13 as shown in FIG. 6(B).

Though the temporary stop position of the leading edge S1 of the succeeding document D13 is limited by the length of various kinds of small documents, the press position of the document support roller 11A, the distance m1, and the like, the document replacement time can be shortened by bringing it as close as possible to the preceding document D12.

Figure 6C:
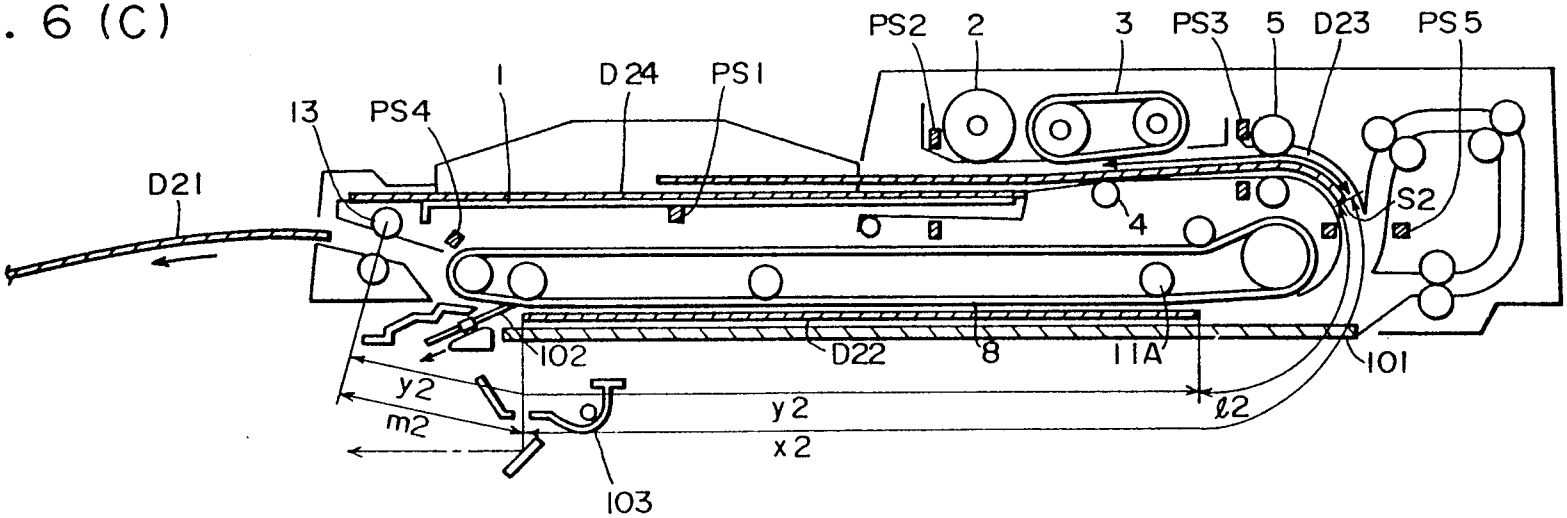

FIG. 6(C) is a schematic view showing the feed and conveying process of large-size documents D21, D22, D23, D24 (e.g. B4. A3, etc.). Here, symbol D21 represents an ejected preceding document ejected outside the machine by the ejecting roller 13 of the ejecting means. D22 is the preceding document which is placed on the document glass plate 101 and whose leading edge is limited by the document stopper 102. D23 is a succeeding document which is in the conveying stand-by state and whose leading end is temporarily stopped at a predetermined position of the downstream of the intermediate conveyor roller 5 in the conveying direction. D24 is a document which is placed on the document stacker 1 and is not yet conveyed.

The leading edge S2 of the succeeding document D23 in the conveying direction is in the temporary stop and stand-by state at the position spaced apart by a distance x2 from the position of projecting portion of the document stopper 102. An interval between the leading edge S2 and the trailing edge of the preceding document D22 keeps a distance l2. This distance l2 is set greater than a distance m2 from the projecting portion of the document stopper 102 to the nip position of the ejecting roller 13 of the ejecting means ($l2 > m2$). Accordingly, the distance x2 described above is set greater than a distance y2 from the trailing edge of the preceding document D22 to the ejecting roller 13 ($x2 > y2$).

When the temporary stop position of the leading edge of the succeeding document D23 is set in this manner, the preceding and succeeding documents D22 and D23 are simultaneously conveyed by the carrying belt 8 while keeping the gap l2 and when the leading edge of the succeeding document D23 abuts against the document stopper 102 and stops there, the trailing edge of the preceding document D22 has already been ejected by the ejecting roller 13, so that ejector failures due to the catch of the trailing edge does not occur.

The succeeding document D23 is conveyed by the distance x2 inside the conveyance path at a predetermined low speed $v_2$ (e.g. $v_2 = 500$ mm/sec) while being nipped between the feed belt 3 and the intermediate conveyor rollers 5, reaches the temporary stand-by positions S2 and stops there. A necessary time t2 of the preparatory conveyance of the succeeding document D23 at this speed $v_2$ is set shorter than an image formation time t02 during which scanning exposure is made by the scanning-exposure unit 103 for the preceding document D22 while its leading edge abuts against the document stopper 102 (t02>t2).

When the preparatory feed speed of the succeeding document D23 and the time necessary for the temporary stop of the leading edge are thus determined, it is possible to preparatively feed the succeeding document D23 to the temporary stop position and to let it stand by there within the scanning exposure time (optical scanning going path) for the preceding document D22 in the same way as described above. Furthermore, since the preceding and succeeding documents D22, D23 are simultaneously conveyed with the predetermined gap between them according to this arrangement, no waiting time exists in the conveying operation of both documents and conveying efficiency can therefore be improved.

Incidentally, the temporary stop position of the leading edge S2 of the succeeding document D23 is determined under the same condition as that of the small size succeeding document D13 described before so as to shorten as much as possible the document replacement time.

Figure 8:
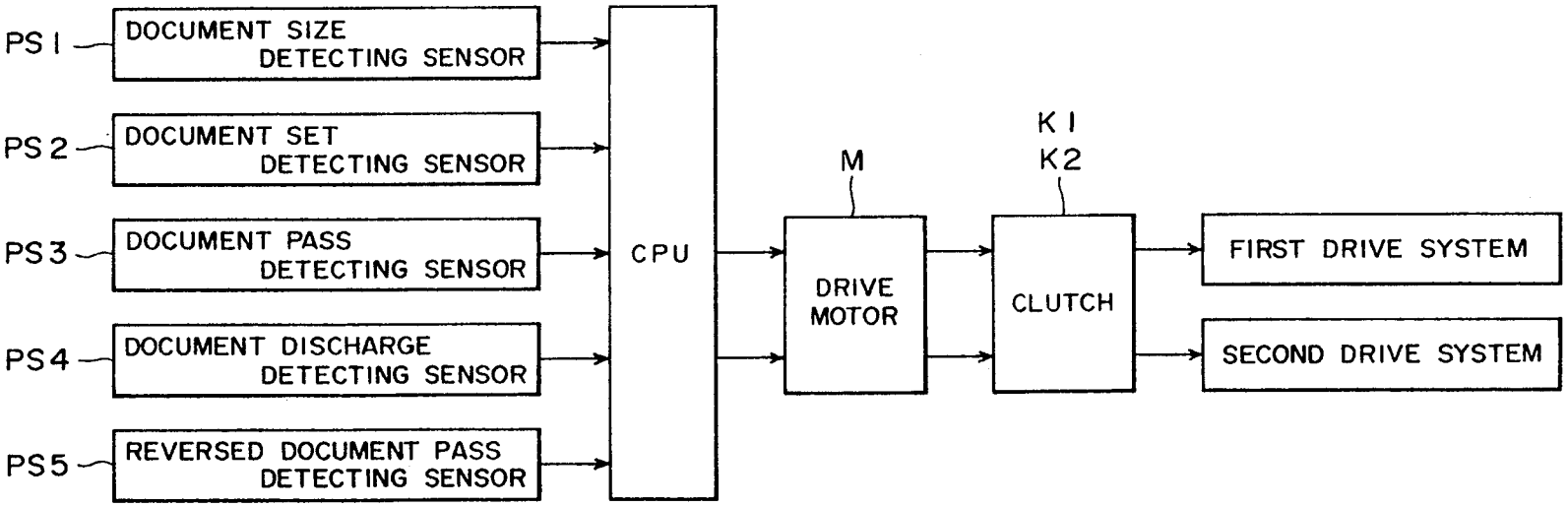
FIG. 8 is a block diagram of the driving system.
Figure 9:
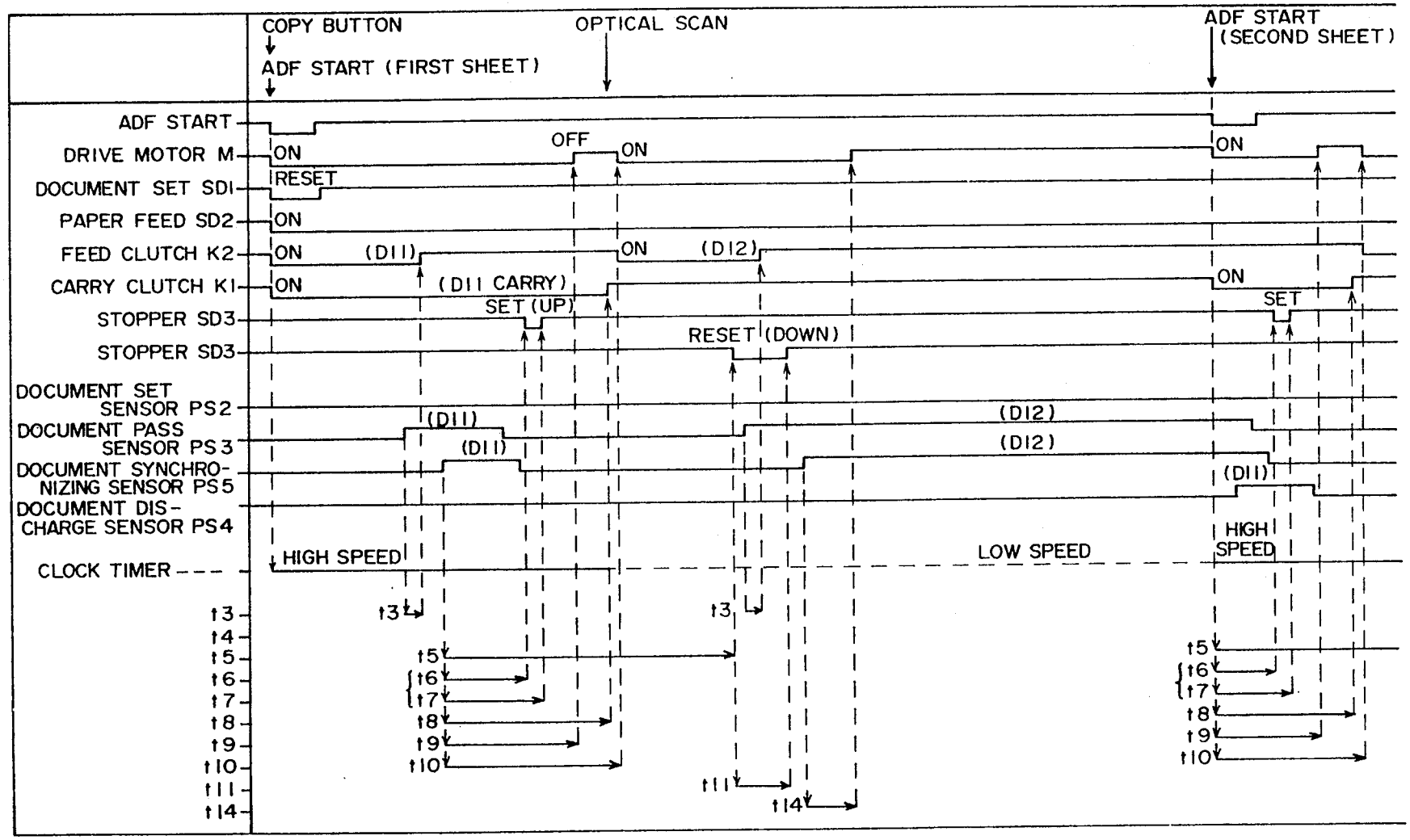
FIGS. 9(A) and 9(B) are time charts showing the feed and conveying process of the document.
Figure 9:
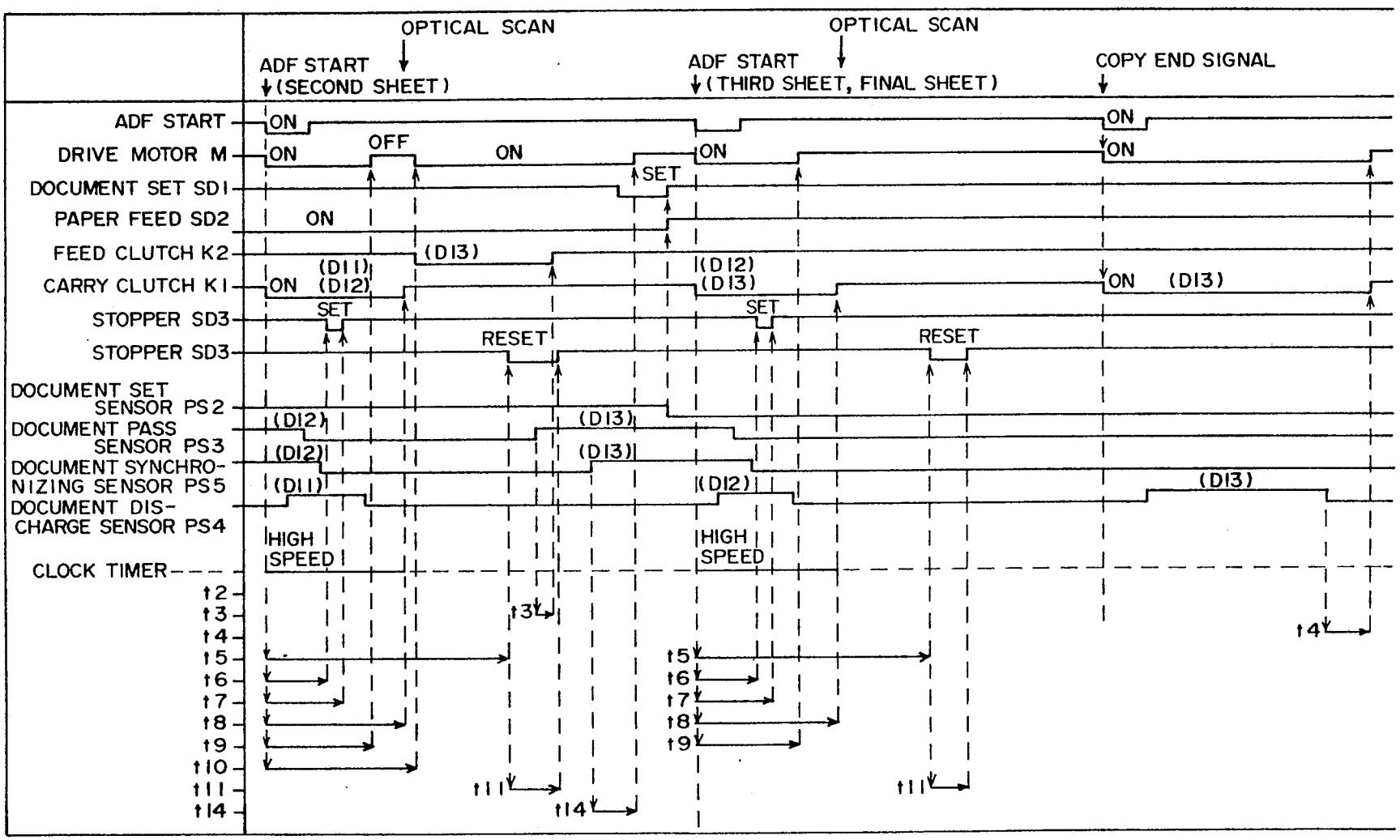

FIG. 7 shows the rotational speed of each feed roller by the driving system, FIG. 8 is a block diagram of the driving system and FIGS. 9(A) and 9(B) are time charts.

The driving and document conveying processes by the automatic document feeding apparatus will be explained with reference to these drawings.

(1) When a stack of documents is placed on the document stacker 1 and abuts against a document edge stopper 1D which is at rest at the projected position, the document setting detection sensor PS2 detects the presence thereof to set the ADF mode.

(2) Breadth regulating boards 1A and 1A are adjustably moved to come into contact with the said edges of documents. Then, the width thereof is detected by the document size detecting sensor PS1, and the CPU is caused to calculate and store the length thereof.

(3) Depressing the copy button 111 allows a starting signal for copying to be inputted so as to start the reproducing machine 100 and the automatic document feeding apparatus.

(4) With this ADF start signal, a voltage is applied to the document setting solenoid SD1 in order to lower the projected end of the document edge stopper 1D. At the same time, a voltage is applied to the document feed solenoid SD2, so that the pick-up roller 2 is lowered to press the top sheet of the stack of documents.

(5) Also, at the time of the start of the driving motor M, the timing belt pulley Pl mounted on the motor driving shaft 20 is simultaneously rotated. Thus, the intermediate shaft 21 with the timing belt pully P2 is rotated through the timing belt B1. At this time, both magnetic clutches K1 and K2 are in ON conditions so as to rotate the feed roller shaft 22 by the rotational movement of the timing belt B3, and to cause the feed belt 3 to be rotatably moved through the gears G1 and G2 as well as the feed roller 3A. The pick-up roller 2 is also rotated by the timing belt B4. At the time of the rotation of the timing belt pulley P7 meshing with the timing belt B3 mentioned above, the intermediate carrier roller shaft 23 is simultaneously rotated to allow the intermediate conveyor roller 5 to be in a rotational condition.

Also, at the same time, the carrier belt driving roller 9 with the timing belt pulley P5 is rotated by the timing belt B2 which is trained around said belt pulleys P3 and P5. Hence, the carrying belt 8 trained around said roller 9 and the free roller 10 is rotatably moved. In this respect, the peripheral speed of each of the pick-up roller 2, feed belt 3, intermediate carrying roller 5, and carrying belt 8 is a high-speed feeding mode $V_1$ (for example, the peripheral speed $V_1$=1,200 mm/sec).

By the rotation of each roller mentioned above and the rotational movement of each belt mentioned above, a document D11 on the top of the stack of documents placed on the document stacker 1 is fed out by the pick-up roller 2, and is handled by the feed belt 3 and the double-feed preventive roller 4. Thus, the first sheet of the top of the documents D11 is separated and fed.

(6) When the leading edge of the document D11 separated and fed as mentioned above is passed through the document pass detecting sensor PS3, a signal is generated to indicate it accordingly. Then, with this signal, the clock timer is started. At a time t3, the document feed clutch K2 is disengaged. Hence, the leading edge of the document D11 is passed through a nipping position of the intermediate conveyor roller 5. Then, the rotational driving of the pick-up roller 2 and the feed belt 3 are stopped. Thereafter, they are driven freely.

(7) The intermediate conveyor roller 5 is continuously driven to rotate so as to carry the document D11 through the document synchronization sensor PS5 onto the document glass plate 101. Then, the document is slidingly carried thereon under pressure by the carrying belt 8 which is being moved.

(8) At a time t6 since the passing of the document through the synchronization sensor PS5 mentioned above, the document stopper solenoid SD3 is actuated to cause the document stopper 102 to be projected above the left upper face of the document glass plate 101. This solenoid SD3 is of latch type, so that unless it is reset, it remains in a state of attraction.

(9) At this time, before the leading edge of the document reaches the document stopper 102, i.e., at a time t9 after the document passes through the synchronous sensor PS5 mentioned above, the driving motor M is suspended and a brake is applied to stop the rotation of the motor. However, because of the inertial force, each driving member is allowed to move continuously for a while. Thus, the document is still carried. In this embodiment, turn-OFF of this motor is effected when the leading end of the document arrives at a position about 5 to 10 mm before the stopper.

(10) Thereafter, the carry clutch K1 is disengaged at a time approximately t8 to control the carrying belt 8 so as to cause the carrying belt 8 to stop. Here, the carrying belt 8 presses the stopped document against the document glass plate.

Also, almost at the time t8, the clock is switched from a high-speed to a low-speed.

(11) At a time t10, the feed clutch K2 is engaged, an the driving motor M is started. Hence, the next document D12 is fed by the pick-up roller 2 and feed belt 3.

When the document is at rest in the image exposure section, the scanning exposure is started by the optical system 103 equipped in the body of the reproducing machine 100. At this time, before the scanning exposure begins or during the period of the scanning exposure, the next document D12 is fed out and carried through the feed belt 3 and the intermediate carrying roller 5.

When the leading edge of the following document D12 is passed through the document pass detecting sensor PS3, a detection signal is given to cause this document D12 to stop at a given position for stand-by with a timing t of the clock timer (or by the pulse-counting of a counter). During this period, the feed magnetic clutch K2 is disengaged to effetuate the double-feed prevention of the following documents as soon as the document is nipped by the intermediate conveyor roller 5. Although the carry magnetic clutch K1 is in the OFF condition to allow the foregoing document D11 to be at rest in the exposure section, the leading edge of the following document D12 is fed to the location in the vicinity of the document glass plate 101 in a low-speed mode $V_2$ during this period, and is in stand-by condition. However, the speed of the movement during this period is set at $V_2$ (for example, $V_2=500$ mm/sec) so as to complete the movement before a restart signal is generated, at least after the termination of the scanning.

The stand-by position of the succeeding document can vary with the lengths of various kinds of document sizes, that is, the length of the documents in the conveying direction.

FIGS. 6(B) and 6(C) are schematic views showing the ejected preceding documents D11, D21 and the feed and conveying process of the preceding documents D12, D22 and the succeeding documents D13, D23.

In FIG. 6(B), the timer starts counting the time after the passage of the leading edge of the succeeding document D13 through the document passage sensor PS3. After a time t2, the feed clutch K2 is turned OFF to stop the feed of the document. Next, after a time t14 counted by the timer from the time of passing of the leading edge of the document D13 through the document synchronization sensor PS5, driving of the driving motor M is stopped. Incidentally, the leading edge of the document D13 is the temporary stop position S1 exists in the position near the document glass plate 101 where the document D13 is not pressed by the carrying belt 8. Therefore, the leading edge of the document D13 is close to the trailing edge of the preceding document, the distance being l.

In other words, the timer starts counting the time t3 from the time at which the leading edge of the succeeding document D13 passes the document passage sensor PS3. After this time t3, the leading edge passes the nip position of the intermediate conveyor roller 5, and the feed clutch K2 is turned OFF and becomes in the free rotation state. The document D13 is subsequently conveyed by the intermediate conveyor roller 5. After the time t14 timed by the timer from the time of the passage of the leading edge of this document D13 through the document synchronization sensor PS5, the driving motor M is stopped to stop the feed of the document D13 temporarily. In the case of small size documents (e.g. B5, A4, etc.), the leading edge of the document D13 at the temporary stop position S1 described above is positioned near the document glass plate 101, where it is not pressed by the carrying belt 8. Accordingly, it is close to the trailing edge of the preceding document by the short distance. In the case of large size documents (e.g. A3, B4, etc.), its leading edge is stopped in the position adjacent to the intermediate conveyor roller 5 and on the downstream side in the conveying direction.

While the document D13 is stationary as described above, the document stopper solenoid SD3 is controlled at times t5, t11 during the predetermined time period when the optical system for scanning of the document returns, so as to move the stopper below the document glass plate 101 and to permit the passage of the document D12 upon its ejection.

If the document described above is the one having the minimum size capable of automatic feed (e.g. B5, transverse position, 182 mm long), the leading edge of the succeeding document D13 approaching the trailing edge of the preceding document D12 stopped on the document glass plate 101 is stopped temporarily at the position S1 shown in FIG. 6(B), that is, at the position close to the document pressing roller 11A inside the wedge-shaped space defined between the document glass plate 101 and the carrying belt 8.

The temporary stop position S1 of the leading edge of the succeeding document D13 described above is set so that when this document D13 is again conveyed towards the document glass plate 101, it can be conveyed at the main conveying speed, namely, at the conveying speed $v_1$ of the carrying belt 8, at least until the trailing edge of this document D13 passes off the intermediate conveyor roller 5.

When the document D13 is conveyed towards the document glass plate 101 by the intermediate conveyor roller 5 by the ADF start signal, and the document D13 starts sliding on the document glass plate 101 while being pressed and held by the conveying force of the carrying belt 8, this arrangement makes it possible to nip and convey the document D13 by the intermediate conveyor belt 5 until the contact area of the leading end portion of the document D13 and the carrying belt 8 becomes a necessary and sufficient value. Thereafter, when the trailing edge of the document D13 passes the nip position of the intermediate conveyor roller 5, the leading edge of the document D13 is conveyed stably in the high speed conveying mode $v_1$ only by the carrying belt 8.

If the temporary stop position S1 for the document having the smallest size is set near the document glass plate 101 so as to determine the length of the conveying path reaching the intermediate conveyor roller 5, the trailing edge portion of any of various documents having larger sizes can be sufficiently nipped by the intermediate conveyor roller 5 at the time of the start of their conveyance, and conveyance can therefore be stabilized.

(12) Next, when a scanning exposure is an ADF start signal is generated from the reproducing machine 100 and the exposure operation for the second document D12 is made. In other words, the driving motor M is made ON and the conveying electromagnetic clutch K1 is also made ON, so that the preceding document D11 is conveyed by the carrying belt 8 and is ejected and placed onto the delivery tray 14 through the ejecting roller 13. At the same time, the succeeding document D12 is nipped and slides on the document glass plate 101 from its stand-by position, and then reaches the document stopper 102 by the stop operation of the motor M. In this manner, the replacement of the documents is completed. The document conveyance by the time counting t8 in this case is done in the high speed conveying mode $v_1$.

(13) The timers t5, t6, t7, t8, t9, t10 are simultaneously started by the ADF start signal described above. The timers t6, t7 set the document stopper solenoid SD3 and the timers t5, t11 reset this solenoid SD3. The timer t8 generates the OFF signal for the conveying clutch K1. Furthermore, the timers t9, t10 and t14 control the ON/OFF of the driving motor M.

The second document D12 is conveyed from the temporary stop position S1 onto the document glass plate 101 in the high speed conveying mode $v_1$, and stopped temporary at the time t9. After the stop, the document D12 abuts against the document stopper 102 because of the inertia and stops there.

Therefore, it is treated in the same way as that of the preceding document D11 and is ejected after subjected to the exposure processing. In the mean time, the third document D13 is fed, placed in the stand-by position and stopped there.

The feeding, conveying, exposure processing and ejecting operation for this third document D13 are made in the same way.

When scanning exposure is completed for the last document D13, a copy end signal is inputted from the reproducing machine 100 and this input signal turns ON the driving motor M and the feed clutch K1, so that the carrying belt 8 moves, the pressing force of this carrying belt 8 causes the frictional conveyance of the document D13, the sliding on the document glass plate 101, and the ejection toward the ejecting roller 13. After the passage of the time t4 from the detection of the trailing edge of the document D13 by the ejection sensor PS4, the driving motor M and the conveyor clutch K1 are turned OFF to complete the operation.

Though the two driving systems are controlled and operated by one motor and two electromagnetic clutches in the embodiment, it is possible to effect the similar operation by the use of two motors and one electromagnetic clutch.

After a document is reversely fed and inverted in the document inverting portion 30 at the time of reproduction of the two-side documents and when it is again conveyed to the document glass plate, the same effect can be obtained by setting a temporary stop position of the document while starting the time counting from the passage detection by the reversed document passage sensor PS5, in the same way as described before.

As described above, the automatic document feed device in accordance with the present invention provides a very remarkable effect especially when applied to a high performance document feed apparatus which makes it possible to reduce the document replacement time by the high speed document conveying. In other words, the document replacement time can be shortened by starting the feed of the succeeding document before completion of the exposure operation of the preceding document, by stopping temporarily the succeeding document in the predetermined position before the image exposure portion to make it in stand-by state. In this manner, the document having the smallest standard size capable of automatic feed can be conveyed stably at the high conveying speed.

The automatic document feed device in accordance with the present invention not only can shorten the document replacement time but also have an effect of smooth document conveyance and of prevention of the damage of the leading edge of the document. Particularly, because the motor, the clutches, the solenoids and various timers are operated on the basis of the ADF start signals from the reproducing machine, and because the document conveyance is controlled by the document size detection signal and by the passage detection means of the preceeding document, the control program is simple and clear and has a small number of factors of erroneous operations, and the production cost can be reduced, too.

Furthermore, two or more temporary stop positions, for the succeeding document can be disposed depending on its document size and the document replacement time can be kept minimum by keeping the distance between the preceding document and the succeeding document at the minimum value. Thus, interference between documents and ejection failure can be improved.

Further, by setting the conveying speed $V_2$ of the succeeding document till it reaches the temporary stop position so as to satisfy the following formula $$V_1 > V_2 \geqq x/t$$

where $V_1$: document conveying speed in image exposure portion, x: conveying distance from the leading edge of document on document stacker in feeding direction to temporary stop position, t: image formation time for scanning exposing document on image exposure portion, the succeeding document can be kept in the stand-by state at the temporary stop position, and because the succeeding document can be fed by a speed lower than the main conveying speed, the document can be prevented from being damaged while improving the productivity and the precision of the stop position, as well as the noise and the driving voltage can be suppressed.

What is claimed is:

1. In an automatic document feeding apparatus which conveys sequentially a plurality of sheet-like documents to an image exposure portion, stops the documents at the image exposure portion and discharge the documents by discharge means after exposed by an optical system, the improvement characterized in that the feed of the succeeding sheet-like document is started before completion of the exposure operation of a preceding sheet-like document, a succeeding document is stopped temporarily and kept in the stand-by state at least in two stop positions corresponding to document sizes respectively on the upstream side of the image exposure portion, according to a document size detection signal from document size detection means, and in that a distance from the leading edge of the succeeding document in the temporary stop state to the leading edge of a preceding document in the image exposure portion is set greater than a distance from the trailing edge of the preceding document in the image exposure portion to a discharge position of the discharge means.

2. The apparatus of claim 1 wherein at least one pair of intermediate conveyor rollers, drivable at variable speeds, are provided on the downstream side of said separation means, in a direction, the temporary stopping positions being set between said intermediate conveyor rollers and said image exposure portions whereby, when documents having various sizes are conveyed from a temporary stop position, said documents may be conveyed at a main conveying speed before a trailing edge of the document completely leaves said intermediate conveyor rollers.

* * * * *